United States Patent [19]

Sellier

[11] Patent Number: 4,585,936

[45] Date of Patent: Apr. 29, 1986

[54] OPTICAL PROCESS FOR DETERMINING THE DIMENSIONS OF AN OBJECT IN RELATIVE MOVEMENT, AND MORE PARTICULARLY OF A COIN IN A PRE-PAYMENT APPARATUS

[75] Inventor: Christian Sellier, Tournon-sur-Rhone, France

[73] Assignee: Mecelec, Tournon-sur-Rhone, France

[21] Appl. No.: 573,736

[22] Filed: Jan. 25, 1984

[30] Foreign Application Priority Data

Feb. 10, 1983 [FR] France ..... 83 02442

[51] Int. Cl.[4] ..... G07F 3/02; H01J 40/14

[52] U.S. Cl. ..... 250/223 R; 194/334

[58] Field of Search ..... 250/223 R, 560; 194/97 R, 102, DIG. 1; 209/576, 577, 578, 579; 235/135

[56] References Cited

U.S. PATENT DOCUMENTS 4,148,388 4/1979 Reyner et al. ..... 194/102
4,172,222 10/1979 Eglise ..... 250/223 R
4,267,916 5/1981 Black et al. ..... 194/102

*Primary Examiner*—Edward P. Westin
*Attorney, Agent, or Firm*—Dowell & Dowell

[57] ABSTRACT

The coin rolls on a track of triangular section with a vertical side and an oblique side, in which it penetrates as a function of its thickness. The difference in time between the beginnings (or ends) of occultation of the upper cells determines the mean speed and from the duration of this occultation is deduced the length of the chord (PQ) at the upper level (Y-Y'). Knowing the mean speed, the cell of the second level (Z-Z') makes it possible to determine the corresponding chord (RS). From (PQ) and (RS) are deduced the heights ($h_1$, $h_2$) above the plane of roll (X-X') and the diameter and thickness of the coin may then be calculated. More simply, (PQ) and (RS) may be compared electronically with recorded values to reject the coin or accept it and possibly record its value.

4 Claims, 11 Drawing Figures

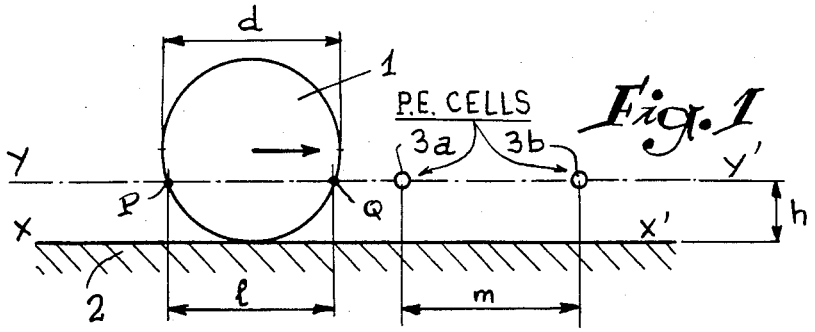
Fig. 1
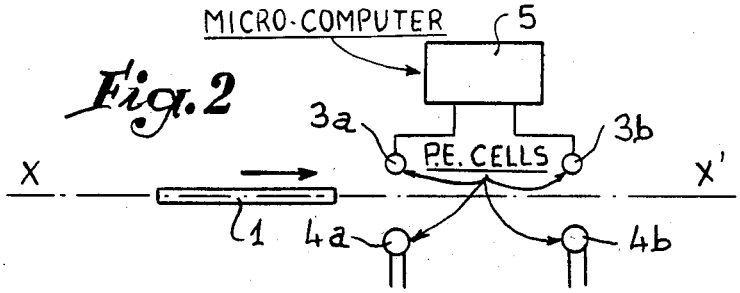
Fig. 2
Fig. 3
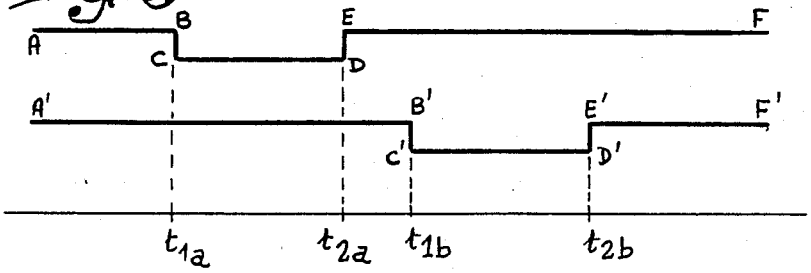
Fig. 4
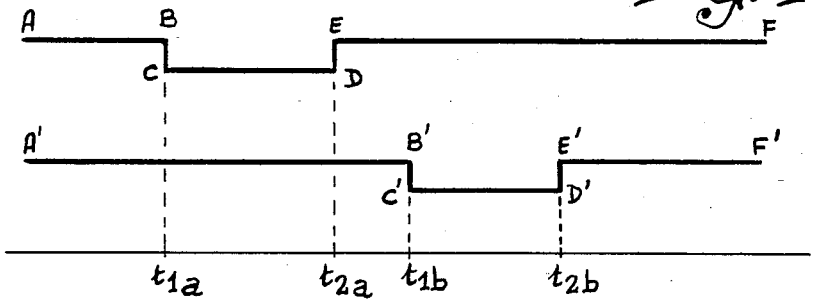

OPTICAL PROCESS FOR DETERMINING THE DIMENSIONS OF AN OBJECT IN RELATIVE MOVEMENT, AND MORE PARTICULARLY OF A COIN IN A PRE-PAYMENT APPARATUS

The present invention relates to an optical process adapted to determine the dimensions of an object in movement with respect to the device itself, and it is more particularly applicable to the case of coins engaged in a pre-payment apparatus, such as an automatic dispenser.

Such apparatus are known to have to sort the coins that they receive, firstly in order to eliminate and return those coins which do not correspond to what the user of the apparatus should have introduced (coins of a value other than that required, counterfeit coins or counters, etc.), but sometimes also to distinguish between several types of coins which can be accepted until the total of their individual values represents the sum required for the apparatus to function. Various devices for automatically effecting such sorting, and other associated devices for testing the metal constituting the coin have therefore been designed.

DESCRIPTION OF RELATED ART

In particular, the coin to be examined is made to circulate in a chute comprising a very slightly inclined wall against which it slides by rolling on a track which, seen in transverse section, comprises a series of steps descending towards the wall, so as to pass it opposite a substantially vertical row of suitably illuminated photoelectric cells. The cells thus detect the diameter of the coin and the level of the step on which it is rolling, which is characteristic of its thickness. However, this system requires a fairly large number of cells and its precision is limited by the spaced apart relationship of the cells in the row as well as by the fineness of the steps of the track.

It is an object of the present invention to provide a particularly simple optical process requiring only a small number of cells which precisely determine or verify the diameter and the thickness of a coin introduced into an apparatus of the type in question. However, it must be understood that it may also be applied to all cases posing similar problems.

SUMMARY OF THE INVENTION

According to the invention, a main cell is disposed on the path of the object in question, said cell being located at a determined level above that of the track on which the object is rolling and, knowing the speed of the latter, a signal representative of the diameter of the object is derived from the occultation time which lapses between the instant when the object covers the cell and the instant when it reveals it again, it being noted that it is then easy to calculate the exact diameter of the object, if desired.

As the speed of advance of the object is generally not known, a second cell is preferably provided, located at the same level as the first, at a determined distance therefrom, and thanks to which this speed may be determined. If, as often happens in dispensing apparatus and the like, the movement of the object is uniformly accelerated, this second cell enables a mean speed to be determined from which it is possible to derive a valid representative signal or to calculate the diameter of the object in question.

According to another feature of the invention, if, in the case of a coin for example, the thickness of the object is also to be determined, the object is made to roll on a track in the form of a notch comprising a side laying in a plane parallel to that of the coin and an oblique side, and a third cell is disposed at a level different from that of the first two. It is easy to see, geometrically, that the three cells make it possible to define for the object an exactly determined circumference which identifies the object and possible enables its diameter to be calculated.

The invention will be more readily understood on reading the following description with reference to the accompanying drawings, in which:

DESCRIPTION OF THE DRAWINGS

FIG. 1 is a schematic view in elevation showing a coin which rolls on a track to pass in front of two successive electric cells lying at the same level.

FIG. 2 is a plan view corresponding to FIG. 1.

FIG. 3 is a graphic representation of the output signals of the two cells in the case of the coin moving at constant speed.

FIG. 4 is a view similar to that of FIG. 3, but corresponding to the case of a uniformly accelerated movement of the coin.

DESCRIPTION OF THE PREFERRED EMBODIMENTS

Figure 5:
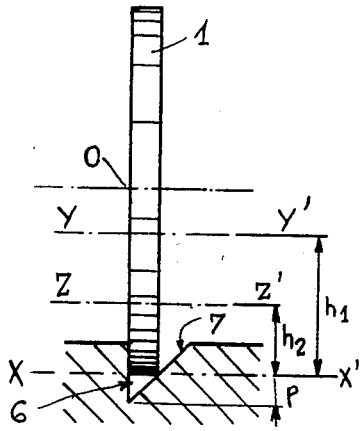
FIG. 5 is a section schematically showing a coin rolling in a notch constituted by a vertical side and an oblique side.

Referring now to the drawings, in the diagrams of FIGS. 1 and 2, reference 1 designates a coin of diameter d lying in a mean vertical plane and which rolls at a constant speed on a surface or track 2 following a rectilinear path X–X', its guiding, retention in the abovementioned plane and advance being ensured by means which have not been shown but which are easy to imagine. It thus passes between a photoelectric cell 3*a* and a light source 4*a* which illuminates the latter. Consequently, the output of the cells takes the profile ABCDEF shown in FIG. 3. Time $t_{1a}$ corresponds to the detection of the front edge of coin 1 and time $t_{2a}$ to the detection of its rear edge. If its uniform speed of displacement v is known, the expression $(t_{2a}-t_{1a})v$ corresponds to the length of segment or chord PQ determined on the circular profile of the coin by its intersection with the horizontal plane Y–Y' in which the cell 3*a* lies. If this length is called l, and if h designates the vertical distance between the planes X–X' and Y–Y', it is easily found that the diameter d of the coin 1 is given by the formula $(l^2+4h^2)/4h$.

In practice, the speed of displacement v of the coin 1 does not constitute a known parameter. To determine it, an auxiliary photoelectric cell 3b is used, also lying in the plane Y–Y', but at a certain distance from cell 3a. The response of this cell to the passage of the coin is indicated by the line A'B'C'D'E'F' in FIG. 3. It is understood that the chronometric shift $t_{1b}-t_{1a}$ is representative of the speed sought and that if m is called the distance which separates the two cells 3a and 3b, the following may be written: $v=m/t(_{1b}-t_{1a})$.

It follows from the foregoing that if the signals or outputs of cells 3a and 3b are sent to a suitably programmed micro-computer 5, the latter may:

either calculate the diameter d of the coin 1 with a precision which depends only on the fineness of detection of cells;

or at least compare the value of segment PQ with one or more reference values recorded in its memory, to decide whether the coin 1 is to be accepted or rejected and, in the former case, to send to an appropriate adder the indication of the value noted, as is necessary in apparatus which require, in order to function, the successive introduction of several coins.

However, it has been assumed hereinabove that the coin 1 moved in a uniform movement. Now, in practice, this is rarely the case. In fact, displacement is ensured by gravity, by suitably inclining the path X–X' on the surface 2 (and naturally inclining the plane Y–Y' in which the cells lie, accordingly). This results in constant acceleration of the coin C'D' then being slightly shorter than CD, as shown in FIG. 4. However, this source of error may easily be eliminated by employing the notion of mean speed, valid in the case of a uniformly accelerated movement and according to which the displacement made between two determined instants is equal to the time whih separates the latter multiplied by the mean value of the instantaeous speeds at each of them. In the case in question, the speed is equal to $m/(t_{1b}-t_{1a})$ upon passage in front of the first cell and to $m(t_{2b}-t_{2a})$ in front of the second. It is easy to program the micro-computer 5 for it to calculate the mean of these two values and for it to use this to determine the diameter of the coin. The two cells 3a and 3b then perform the same role.

However, the foregoing explanations leave aside an important factor for the coin sorting operation, namely the thickness of the coins.

Figure 7:
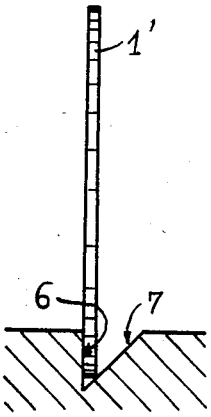
FIGS. 7 and 8 are views similar to that of FIG. 5, but corresponding to coins of different thicknesses.
Figure 8:
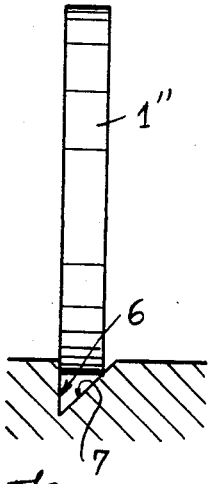

To determine the thickness, it is provided not to roll the coin 1 on a plane surface or track, but in a rectilinear notch comprising (FIG. 5) a vertical side 6 and an inclined side 7. The height p of the path of roll X–X' (FIG. 6) of the coin above the bottom of the groove is directly proportional to the thickness thereof. For a thinner coin 1' (FIG. 7), the path in question is located lower, whilst for a thicker coin 1'' (FIG. 8), it is higher.

Furthermore, a third photoelectric cell 3c is disposed over the length of the groove, located in a horizontal plane Z–Z' different from that Y–Y' of the cells 3a and 3b. $h_2$ designates the height of this plane above the path of roll X–X' of coin 1, the height of plane Y–Y' being here designated by $h_1$.

Figure 6:
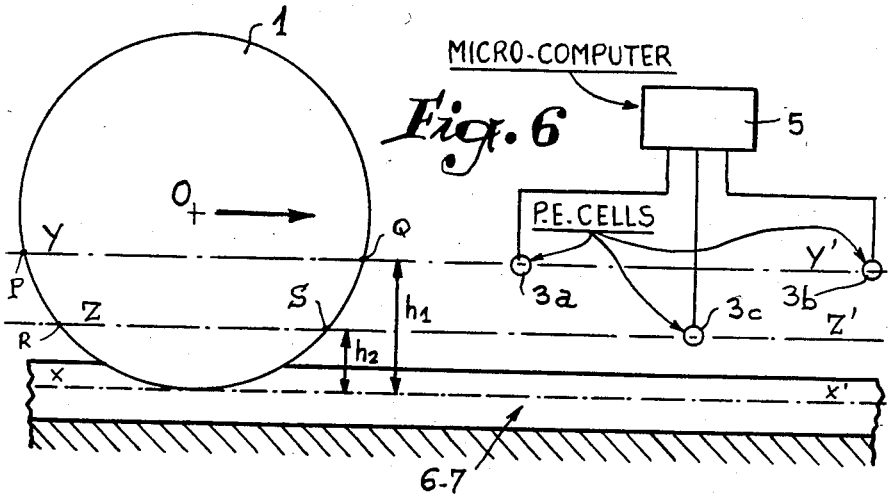
FIG. 6 is a schematic view showing the coin of FIG. 5 a little before it passes in front of three cells disposed at two different levels with a view to identifying its diameter and its thickness.
Figure 9:
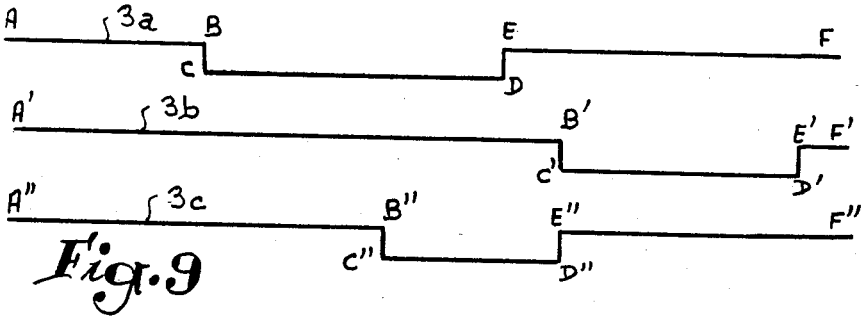
FIG. 9 is a graphic representation of the output signals of the three cells of FIG. 6.

This cell also responds to the passage of coin 1 by sending corresponding signals to the micro-computer 5. By way of indication FIG. 9 shows the aspect of the three signals thus received by the computer, namely ABCDEF for the first cell 3a, A'B'C'D'E'F' for the second 3b, and A''B''C''D''E''F'' for the third 3c, assuming the three cells to be disposed in elevation as indicated in FIG. 6. The speed of the coin being measured by cells 3a and 3b, this third cell 3c for its part enables the segment or chord RS to be measured as a function of this speed.

If the coin 1 rolls well on the path X–X' provided therefor, the micro-computer must derive from the signals of cell 3c a diameter strictly equal to that calculated from those received from cells 3a and 3b. If this is not the case, the coin follows a different path located below or above X–X', therefore it does not have the thickness provided.

Of course, to operate correctly, the possible acceleration of the coin during its passage in front of the cells must, there again, be taken into account. This is easily obtained by disposing the cell 3c between the cells 3a and 3b in the longitudinal direction and at an equal distance therefrom. Cell 3c then lies in a zone where the instantaneous speed of the coin is equal to its mean speed between the first two cells.

It should also be noted that the device described with reference to FIG. 6 may operate correctly even if the plane Y–Y' passes substantially through the centre O of the coin. In fact, if in that case cells 3a and 3b are virtually not affected by the small variations of penetration of the coin in notch 6–7, the third cell 3c, located at a clearly different level, is sufficiently affected to enable the coin in question to be identified.

Referring still to FIG. 6, it may further be noted that, if it can be considered that the speed of the coin is constant and is known, it is possible to dispense with cell 3b, cell 3a being sufficient to determine the length of the chord PQ.

If the coins not corresponding to a determined model are simply to be eliminated, ascertainment of the identity or non-identity of the diameters determined from the respecitve level Y–Y' and Z–Z' is then sufficient. If, as is the case with certain ticket dispensers, the apparatus in question must successively receive a plurality of different coins in order to operate, the device may then send to the micro-computer 5 signals indicative of the length of the segments PQ and RS which it has measured. The micro-computer compares these data with those recorded in its memory and decides whether or not the coin can be accepted. In the negative, it rejects it and in the affirmative it sends the representation of its value to an appropriate adder adapted to trigger the pre-payment apparatus when the total provided has been reached.

However, it may also be desired to know the real diameter of the coins despite the greater or lesser height of the level of their path of roll in the notch 6–7.

Figure 10:
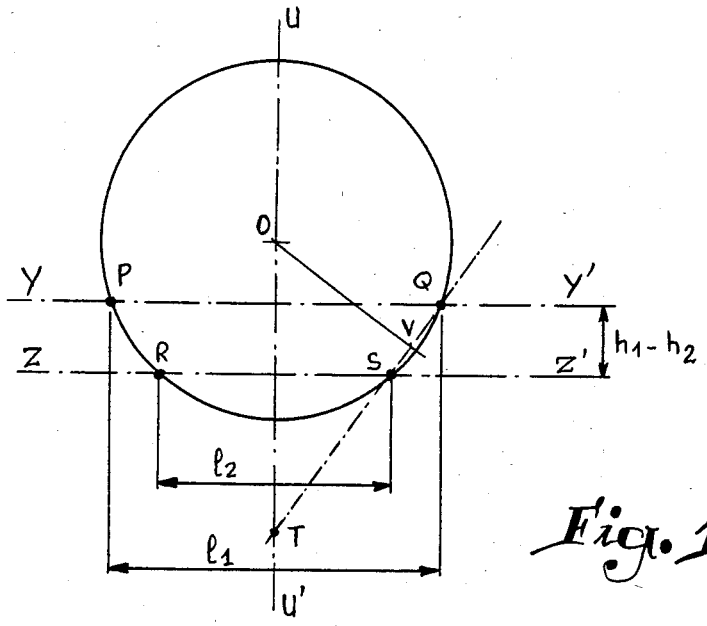
FIG. 10 shows how the diameter of the coin can be calculated as a function of the responses of these three cells.

FIG. 10 shows that calculation of the diameter of the circle representative of the coin 1 (or 1' or 1'', FIGS. 7 and 8) is perfectly possible from the signals received from the cells, without having to take into account the height of the path of roll of the coin in question. In fact, if $l_1$ here designates the length of the chord PQ measured by the cells 3a and 3b and $l_2$ designates that of the chord RS determined by the third cell 3c, it will easily be seen that, if they are disposed symmetrically with respect to a vertical axis, taking care to maintain them at distance $h_1$–$h_2$ from the horizontal planes Y–Y' and Z–Z', the four points PQRS clearly define a single circumference whose diameter may be calculated when $l_1$, $l_2$, $h_1$, $h_2$ are known. In order not to complicate the present description unnecessarily, this calculation, which does not give any major difficulty, will not be described in detail. It will simply be indicated that it may be based in particular on the similarity of the triangles defined by the oblique chord QS and its extension until it intersects the vertical axis U–U' at T and of a third triangle defined by this axis U–U', by the perpendicular OV which, starting from centre O, terminates at the centre of the oblique chord QS, and by the oblique segment VT. This calculation is not beyond the possibilities of a suitably programmed micro-computer. Once the diameter of the coin is known, it is easy to calculated its thickness, if desired, by determining the height of the centre O above one of the segments PQ and RS, adding to the value thus found the height of the plane of this segment above that of the entrance of the notch 6–7, then subtracting from the total the radius of the coin. The sought-after thickness is deduced from the value of this penetration.

Figure 11:
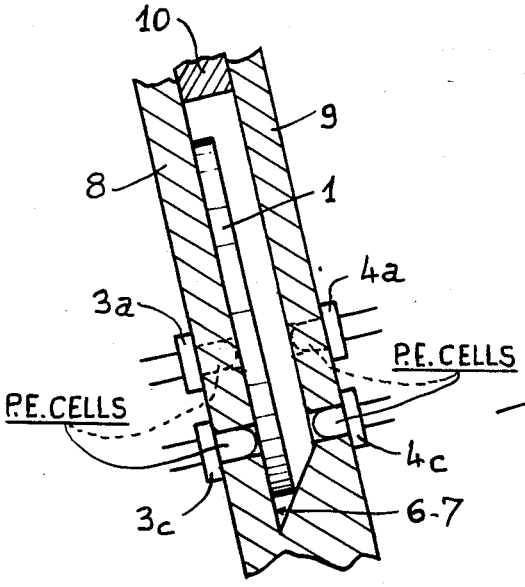
FIG. 11 is a section showing a possible practical embodiment of the device shown schematically in FIGS. 5 and 6.

FIG. 11 very schematically indicates how a device according to the invention can be made in practice. 8 designates a slightly inclined wall on which the coin 1 slides in known manner. The cells such as 3*a* and 3*b* are mounted in perforations in the wall 8. This constitutes the vertical side 6 of the lower notch, of which the inclined side 7 joins another wall 9 which defines with the preceding one 8 the chute in which the coins introduced into the apparatus circulate. This chute is closed at the top by an upper cover strip 10. Opposite the cells are light emitters, in the present case 4*a* for cell 3*a* and 4*c* for cell 3*c*. These emitters may be photodiodes, the cells being for their part phototransistors. However, any other type of equivalent elements may of course be used, particularly pin-point incandescent lamps with suitably calibrated lenses and diaphragms in the event of it being desired to obtain particularly high precision. It would also be possible to employ devices integrating emitters and receivers on the same side of the chute (of the bar code reader type).

It must moreover be understood that the foregoing description has been given only by way of example and that it in no way limits the domain of the invention which would not be exceeded by replacing the details of execution described by any other equivalents. For example, at least one of planes Y–Y' and Z–Z' might lie above the centre of the coin. The spaced apart relationship between 3*a* and 3*b* may vary.

What is claimed is:

1. A process for determining or verifying the dimensional thickness and diameter characteristics of a flat object, and more particularly of a coin, which is rolled on an inclined track so that it passes in front of plural normally illuminated photoelectric cell means whose illumination it interrupts upon passage thereby, said cell means including a main cell and auxiliary cell means located at predetermined different levels above the track, including the steps of:

rolling the object along said track which is provided in the vicinity of the cell means with a section in the form of a notch, with a first side parallel to the plane of the object and a second side whose general profile makes a determined angle with the first side, obtaining outputs from the cell means representing the times of interruption of the illumination thereto by the object, and computer calculating from said outputs, taking into account the speed of the object, signals representative of the diameter and thickness of the object for a determined depth of penetration of this object is the notch, whereby the signals thus derived from said outputs make it possible either to calculate the diameter and thickness of the object, or, by comparison with recorded data, to verify whether it comes into a predetermined recorded category.

2. The process of claim 1, wherein, in the section of the track in the form of a notch, the oblique side is uniformly rectilinear.

3. The process of claim 1, wherein, with a view to determining the speed of displacement of the object on the track since this speed may be uniformly accelerating, two successive main cells are provided which are disposed at the same level at a determined distance from each other, outputs from the main cells making it possible to calculate the mean speed of the object, the auxiliary cell means being placed longitudinally between the two main cells and at an equal distance therefrom.

4. The process of claim 1, wherein the responses of the cell means are sent to a microcomputer which calculates the diameter and the thickness of the object.

* * * * *